US010875352B1

(12) United States Patent
Dawson et al.

(10) Patent No.: US 10,875,352 B1
(45) Date of Patent: Dec. 29, 2020

(54) WALL MOUNTED DISPLAY BOARD SYSTEM WITH A BASE CASTOR AND METHOD OF USE

(71) Applicants: Dony Dawson, Fort Worth, TX (US); Jeffrey R. Weilert, Fort Worth, TX (US); Stephen Savoie, Keller, TX (US)

(72) Inventors: Dony Dawson, Fort Worth, TX (US); Jeffrey R. Weilert, Fort Worth, TX (US); Stephen Savoie, Keller, TX (US)

( * ) Notice: Subject to any disclaimer, the term of this patent is extended or adjusted under 35 U.S.C. 154(b) by 353 days.

(21) Appl. No.: 15/979,760

(22) Filed: May 15, 2018

Related U.S. Application Data

(60) Provisional application No. 62/608,255, filed on Dec. 20, 2017.

(51) Int. Cl.
*B43L 1/00* (2006.01)

(52) U.S. Cl.
CPC ..... *B43L 1/00* (2013.01)

(58) Field of Classification Search
CPC ..... B43L 1/00
USPC ..... 434/408, 413, 414, 419, 420, 421, 425, 434/428, 430; 40/475, 492, 606.15, 40/611.02
See application file for complete search history.

(56) References Cited

U.S. PATENT DOCUMENTS 236,610 A * 1/1881 Moon ..... B42D 17/00 281/43
1,958,579 A * 5/1934 Johnson ..... A47B 97/001 434/414
2,655,740 A * 10/1953 Goodrich ..... A47B 97/001 434/414
4,785,565 A * 11/1988 Kuffner ..... A47F 5/105 160/135
5,492,476 A * 2/1996 Ball ..... B43L 1/06 40/605
5,941,713 A * 8/1999 Wayner ..... B43L 1/06 248/441.1
6,272,779 B1 * 8/2001 Seiber ..... G09F 7/18 248/453
6,612,057 B2 * 9/2003 Shoemaker ..... G09F 7/18 248/289.31
6,854,202 B1 * 2/2005 Ives ..... G09F 15/0087 40/491
6,955,130 B2 * 10/2005 Phillips ..... A47B 97/04 108/189
7,195,491 B1 * 3/2007 Chen ..... B43L 1/00 434/408
7,862,341 B2 * 1/2011 Durand ..... A47B 9/14 434/408
8,136,680 B2 * 3/2012 Sugarman ..... A47B 97/001 211/85.7
2006/0073466 A1 * 4/2006 Solomon ..... B43L 19/0056 434/408
2006/0216686 A1 * 9/2006 McComb ..... B43L 1/04 434/408

(Continued)

*Primary Examiner* — Kurt Fernstrom
(74) *Attorney, Agent, or Firm* — Eldredge Law Firm, LLC; Richard Eldredge

(57) ABSTRACT

A wall mounted display board system includes a frame; a hinging system to mount on a wall surface and engage with the frame; a panel mounted on a front of the frame; and a castor mounted on a bottom portion of the frame to rest on a ground surface; the hinging system allows the frame and panel to pivot; and pivoting of the hinging system and the frame moves the castor along the ground surface.

16 Claims, 5 Drawing Sheets

(56) References Cited

U.S. PATENT DOCUMENTS

| | | | | |
|---|---|---|---|---|
| 2013/0101980 | A1* | 4/2013 | Dorney | C03C 27/00 434/408 |
| 2013/0260362 | A1* | 10/2013 | Melashenko | E04B 2/7431 434/430 |
| 2014/0272917 | A1* | 9/2014 | Hall | B43L 1/00 434/408 |
| 2017/0232783 | A1* | 8/2017 | Oh | B60B 33/063 434/408 |

* cited by examiner

WALL MOUNTED DISPLAY BOARD SYSTEM WITH A BASE CASTOR AND METHOD OF USE

BACKGROUND

1. Field of the Invention

The present invention relates generally to writing board systems, and more specifically, to a wall mounted display board system with a base castor and hinge system allowing for vertical shifting of the display board system when pivoted relative to the wall.

2. Description of Related Art

Writing board systems are well known in the art and are effective means to provide a surface on which to write or project an image. Conventional writing boards typically consist of chalk boards or dry erase boards permanently secured to a wall surface. During use, the user marks on the surface of the writing board while an audience views the board.

One of the problems commonly associated with conventional writing boards is the singular angle of display. For example, conventional writing boards are conventionally mounted flat against the wall, thereby only providing clear visibility to those sitting or standing directly in front of the board, or at least within a small window area in front of the board.

Accordingly, although great strides have been made in the area of writing board systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
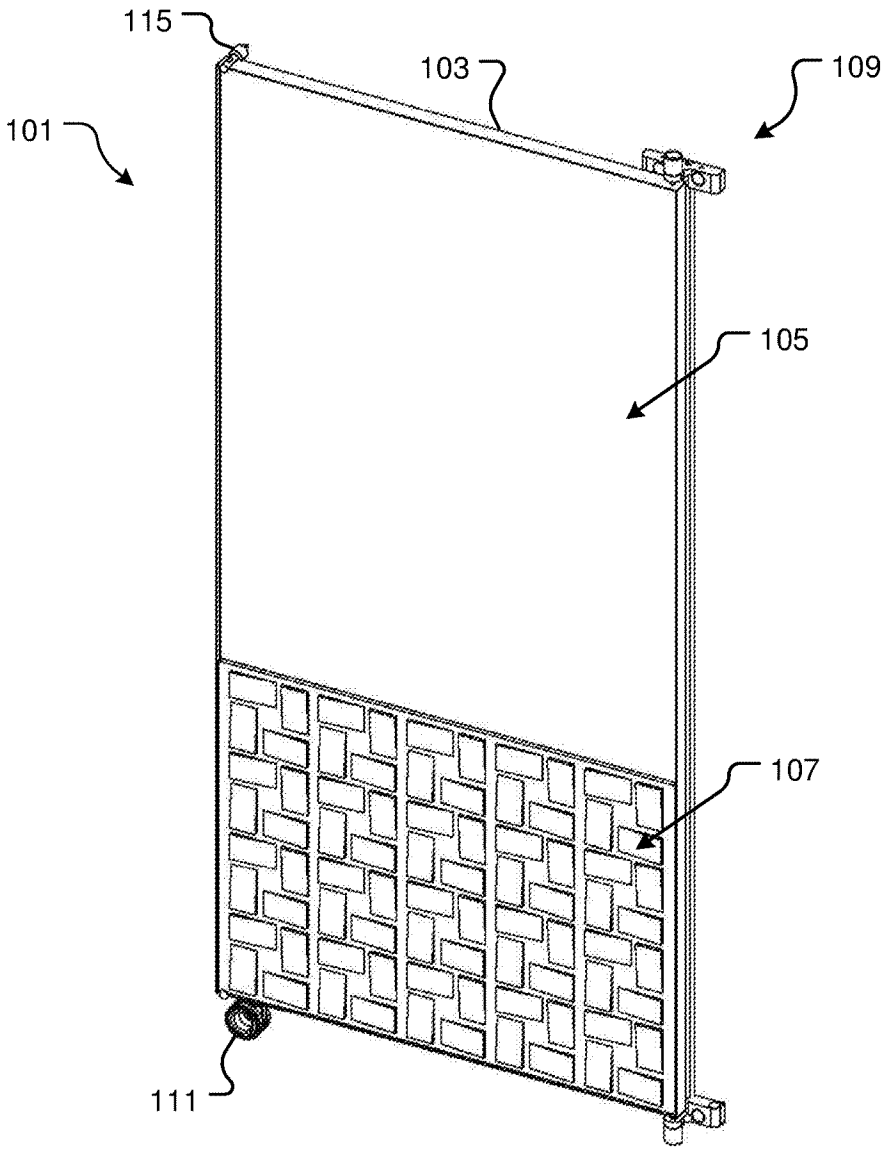
FIG. 1 is an oblique view of a wall mounted display board system in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional writing board systems. Specifically, the present invention provides a mounted display board system with the ability to easily and smoothly pivot relative to a wall surface. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
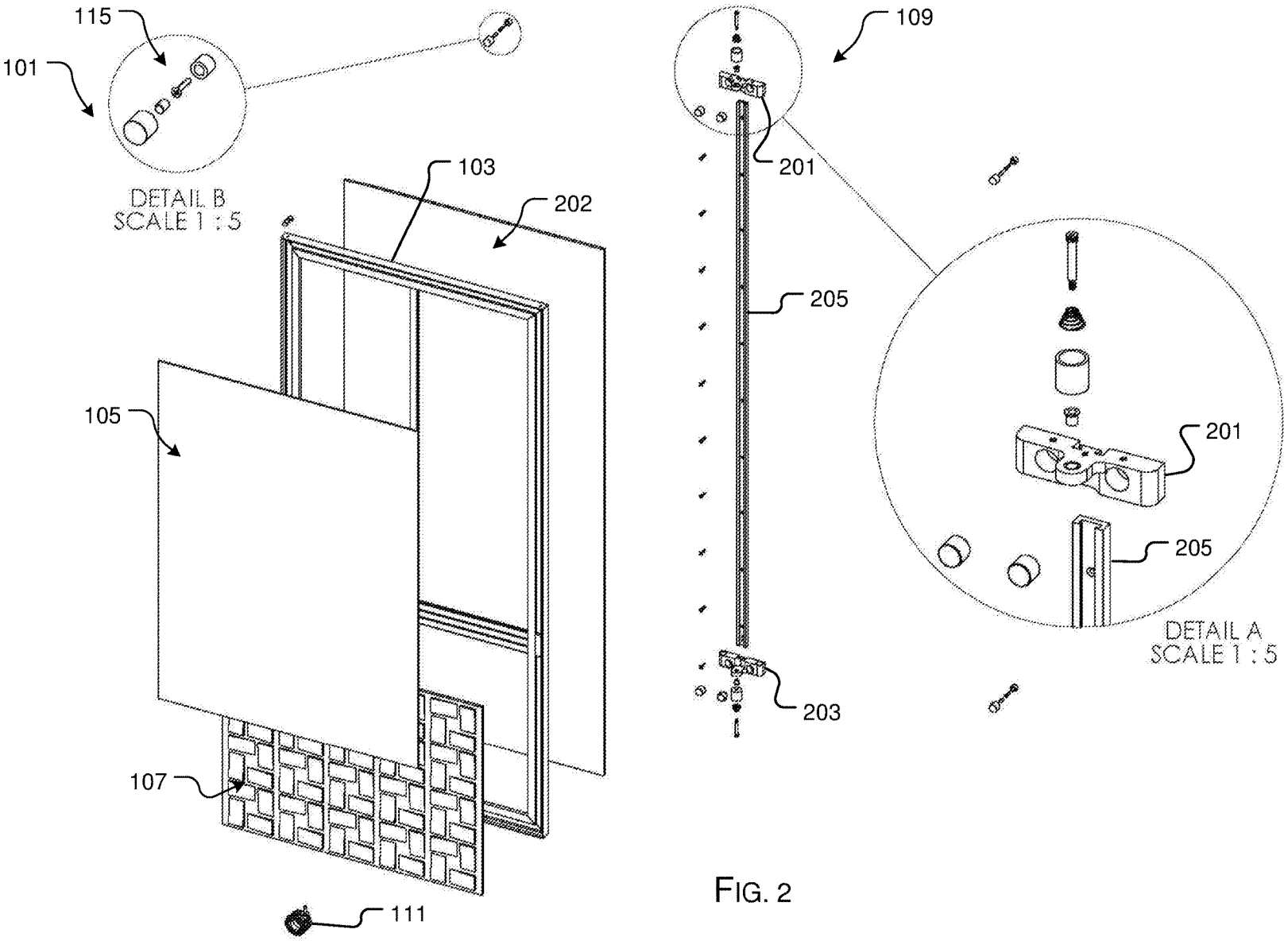
FIG. 2 is an exploded view of the system of FIG. 1.

Referring now to the drawings wherein like reference characters identify corresponding or similar elements throughout the several views, FIGS. 1 and 2 depict oblique views of a mounted display board system 101 in accordance with a preferred embodiment of the present application. It will be appreciated that system 101 overcomes one or more of the above-listed problems commonly associated with conventional writing board systems.

In the contemplated embodiment, system 101 includes a frame 103 with one or more panels 105, 107 mounted to a front of frame 103. In a preferred embodiment, a first panel 105 is a glass writing board and a second panel 107 is an acoustic panel configured to dampen sound waves, however it is contemplated that additional panels could be used, or alternative materials such as chalk boards, dry erase white boards, or any other material could be used. System 101 can further include a third panel 202 secured to a back of frame 103. In the preferred embodiment, the third panel is an acoustic panel configured to dampen noise, however, this panel could further be a second writing surface or other materials.

System 101 further includes a hinge system 109, the frame 103 being mounted to hinge system 109 to further be secured to a wall surface. Hinge system 109 can include various components, such as one or more mounting brackets 201, 203, and is configured to allow for vertical pivoting of frame 103. In addition, hinge system 109 can include one or more rails 205 to engage with one or more bars (not shown), to create the hinge mechanism and allow for vertical shifting.

Figure 4B:
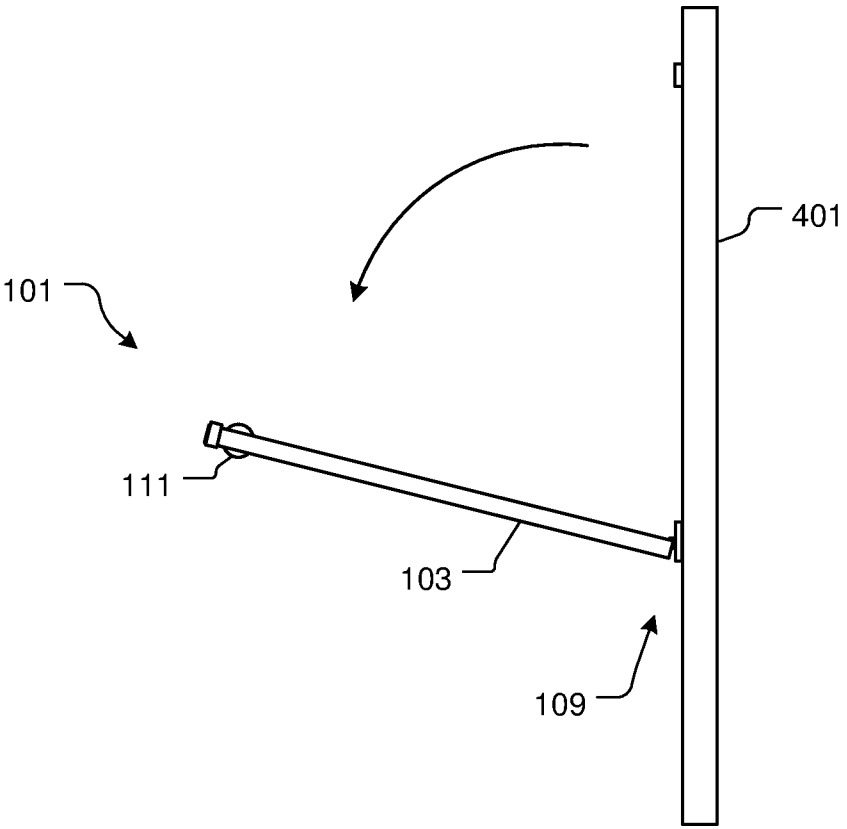
FIGS. 4A and 4B are simplified top views of the system of FIG. 1 showing pivoting of the system relative to a wall.
Figure 4A:
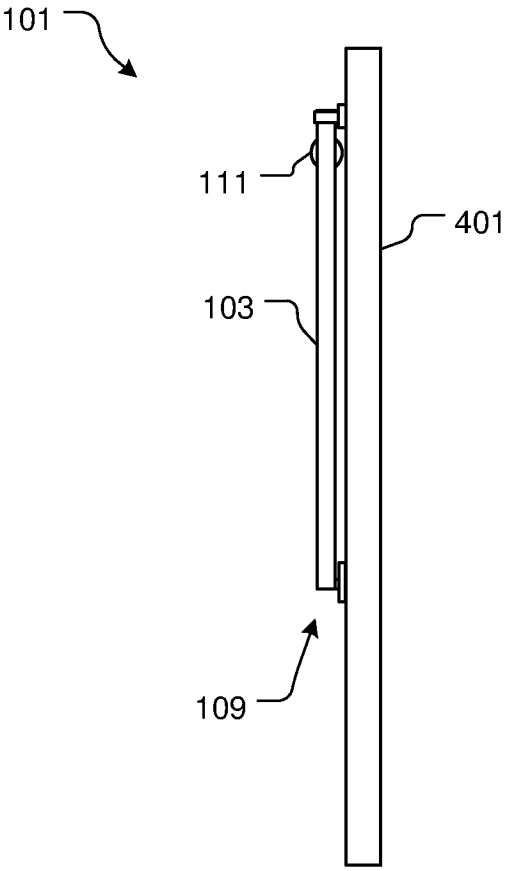

System 101 further includes one or more casters 111 attached at a base of frame 103. Caster 111 allows for gliding over a ground surface and supporting of frame 103 and panels 105, 107. As shown in FIGS. 4A and 4B, frame 103 pivots relative to a wall 401 via hinge system 109, while castor 111 remains in contact with a ground surface.

It should be appreciated that one of the unique features believed characteristic of the present application is the incorporation of a hinge system and caster into a wall mounted display board, thereby allowing for pivoting movement of the display system, while the caster supports the display system on the ground surface.

System 101 can further include one or more securing devices 115 configured to retain frame 103 and display panels 105, 107 next to the wall surface. In one embodiment, devices 115 are magnetic, however, alternative embodiments contemplate the user of any known fastener in the art suitable for such purpose.

Figure 3:
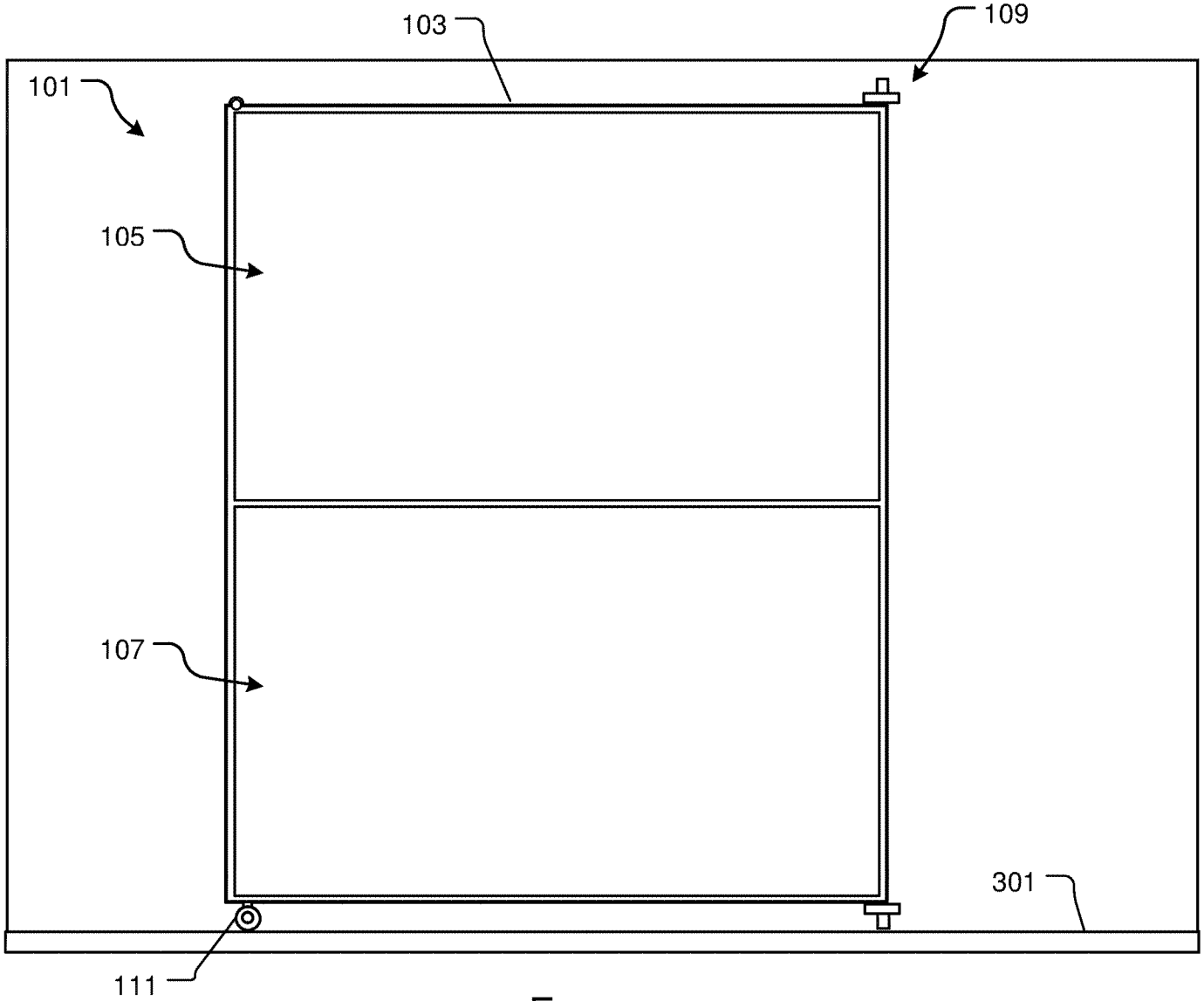
FIG. 3 is a simplified front view of the system of FIG. 1 mounted on a wall surface.

In FIG. 3, a front view of system 101 shows the placement of caster 111 relative to a ground surface 301. In addition, it should be appreciated that the hardware components of hinge system 109 are primarily hidden from view by being placed behind the frame 103 and panels 105, 107, thereby providing an aesthetically pleasing appearance.

Figure 5:
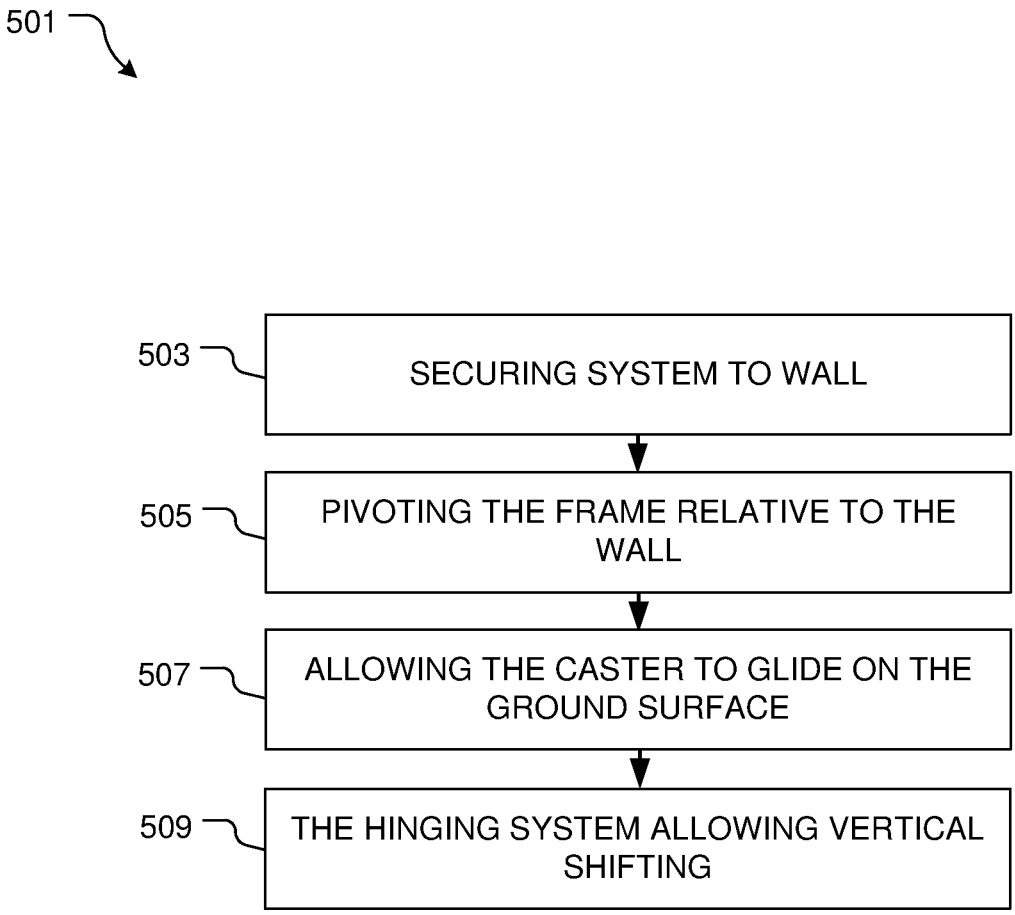
FIG. 5 is a flowchart of the method of use of the system of FIG. 1.

In FIG. 5, a flowchart 501 depicts a method of use of system 101. During use, the system is mounted to a wall surface via the hinge system and the frame, as shown with box 503. The user can then pivot the frame relative to the wall surface as desired, as shown with box 505. During pivoting, the caster glides over the ground surface to support the frame and panels, as shown with box 507. The hinging system allows for the frame to shift vertically, as shown with box 509. It should be appreciated that the vertical shifting of the frame via the hinging system allows for the caster to remain on the ground surface even if the ground is uneven, or the wall is uneven.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A wall mounted display board system, comprising:

a frame;

a hinging system configured to mount on a wall surface and engage with the frame; a panel mounted on a front of the frame; and a caster mounted on a bottom portion of the frame and configured to rest on a ground surface;

wherein the hinging system allows the frame and panel to pivot; and wherein pivoting of the hinging system and the frame moves the caster along the ground surface; and wherein the hinging system allows for vertical shifting of the frame relative to the hinging system.

2. The system of claim 1, wherein the panel further comprises: a first panel mounted on a first portion of the frame; and a second panel mounted on a second portion of the frame.

3. The system of claim 2, wherein the first panel is a glass writing board.

4. The system of claim 2, wherein the second panel is an acoustic panel configured to reduce sound vibrations.

5. The system of claim 1, wherein the hinging system is engaged with a back surface of the frame, thereby concealing the hinging system from view.

6. The system of claim 1, wherein the hinging system comprises:

a rail to be mounted on the wall surface; and a rod configured to engage with the rail;

wherein the rail allows for vertical shifting of the rod.

7. The system of claim 1, further comprising:

a second panel mounted on a back of the frame.

8. The system of claim 7, wherein the second panel is an acoustic panel.

9. A board, comprising:

a frame having a front surface and a back surface;

a hinging system secured to the frame and a support structure; a panel secured to the front surface; and a caster secured to a bottom portion of the front surface;

wherein the hinging system allows the frame and panel to pivot; and wherein pivoting of the hinging system and the frame moves the caster along a ground surface;

wherein the hinging system allows for vertical shifting of the frame relative to the hinging system.

10. The board of claim 9, wherein the panel further comprises: a first panel mounted on a first portion of the frame; and a second panel mounted on a second portion of the frame.

11. The board of claim 10, wherein the first panel is a glass writing board.

12. The board of claim 10, wherein the second panel is an acoustic panel configured to reduce sound vibrations.

13. The board of claim 9, wherein the hinging system is engaged with a back surface of the frame, thereby concealing the hinging system from view.

14. The board of claim 9, wherein the hinging system comprises: a rail to be mounted on the support structure; and a rod configured to engage with the rail;

wherein the rail allows for vertical shifting of the rod.

15. The board of claim 9, further comprising: a second panel mounted on a back of the frame.

16. The board of claim 15, wherein the second panel is an acoustic panel.

* * * * *